US009255756B1

(12) United States Patent
Wu et al.

(10) Patent No.: US 9,255,756 B1
(45) Date of Patent: Feb. 9, 2016

(54) MULTIFUNCTIONAL CROSSBOW

(71) Applicants: Yue Wu, Hang Zhou (CN); Jesse Chow, Surrey (CA)

(72) Inventors: Yue Wu, Hang Zhou (CN); Jesse Chow, Surrey (CA)

( * ) Notice: Subject to any disclaimer, the term of this patent is extended or adjusted under 35 U.S.C. 154(b) by 0 days.

(21) Appl. No.: 14/471,803

(22) Filed: Aug. 28, 2014

(51) Int. Cl.
*F41B 5/12* (2006.01)

(52) U.S. Cl.
CPC ..... *F41B 5/123* (2013.01)

(58) Field of Classification Search
CPC ..... F41B 5/12; F41B 5/123
USPC ..... 124/25
See application file for complete search history.

(56) References Cited

U.S. PATENT DOCUMENTS 5,437,260 A * 8/1995 King ..... F41B 5/12 124/25
5,649,521 A 7/1997 King
7,204,242 B2 4/2007 Dziekan
7,578,289 B2 * 8/2009 Norkus ..... F41B 5/0094 124/25
8,453,631 B1 6/2013 Kronengold et al.
8,919,332 B2 * 12/2014 Trpkovski ..... F41B 5/0094 124/23.1
2005/0279338 A1 * 12/2005 Dziekan ..... F41B 5/12 124/25
2008/0251058 A1 * 10/2008 Colley ..... F41B 5/105 124/25

FOREIGN PATENT DOCUMENTS

EP 1495278 B1 1/2005

* cited by examiner

*Primary Examiner* — Gene Kim
*Assistant Examiner* — Jeffrey Vanderveen
(74) *Attorney, Agent, or Firm* — McQIPLaw; Jeffrey M. McQuiston

(57) ABSTRACT

The present invention is directed to a crossbow operable for shooting missiles. The crossbow comprises: (a) a left-side bowhead and a right-side bowhead; (b) a left-side bow limb and a right-side bow limb; (c) a cam wheel affixed to the anterior end and the posterior end of each of the left-side and right-side bowheads and the left-side and right-side bow limbs; (d) a left-side bowhead string and a right-side bowhead string; (e) a connecting string; (f) a retention base affixed to the connecting string; and (h) a tiller capable of cocking and firing the crossbow.

9 Claims, 4 Drawing Sheets

MULTIFUNCTIONAL CROSSBOW

BACKGROUND OF THE INVENTION

1. Technical Field

The present invention relates to multifunctional crossbow, which is suitable for shooting a variety of missiles, including arrows and balls.

2. Description of Related Art

The invention relates to a cross bow used by people engaged in hunting and target practice in general. Typically, the cross bow is in the form of a bow mounted on a stock in the general form of a rifle. The string of the bow is drawn back to a cocked position and is locked in that position under the control of the trigger until an arrow is fired. The cross bow allows the use of a relatively higher tension for the string as compared to an ordinary bow because both hands are available for cocking or a mechanical device can be used, and once the string is cocked, it remains cocked until it is discharged. An ordinary bow is drawn with a single hand and can only be maintained in a cocked position by physically holding the string in the cocked position.

Prior art cross bows are designed to fire a single arrow and then require recocking and reloading. That is, the cross bows are "single barrel" or single shot bows. It would be highly advantageous to have a "double barrel" cross bow so that two shots could be fired separately as needed. This is particularly beneficial for game hunting where the first shot misses or slightly wounds the game and the rapid firing of a second round is essential for hitting the game or minimizing the pain the game must endure.

U.S. Pat. No. 5,649,521 describes a crossbow for shooting projectiles. The crossbow includes a frame with flexible bow arms and a bowstring connecting the arms, a trigger assembly for retaining the bowstring in a cocked position and releasing to propel the projectile, and a hollow barrel with interior rifling into which projectiles are loaded and through which they are expelled. A firing bolt is connected to the bowstring and located in the barrel to transfer force from the bowstring to the projectile. The barrel includes an elongated slot therealong. The firing bolt is slidably supported on rails on the exterior of the barrel. The firing bolt includes a driving member which extends through the slot to contact the projectile.

U.S. Pat. No. 8,453,631 describes a crossbow that includes an elongated frame coupled to a riser at a first end thereof. The riser supports a pair of flexible limbs, and a bowstring extends between the limbs. A movable bowstring release is used both to retract the bowstring into a drawn position, and to release the bowstring under the operation of a trigger assembly. The bowstring release is initially positioned near the bowstring at rest, and a bowstring hook is engaged therewith. A bowstring retractor includes a retractor rope secured to the bowstring release for retracting the bowstring. An upper housing is secured to the second end of the elongated frame, and supports a rope spool used to wind the retractor rope. The bowstring release is retracted into the upper housing proximate a trigger assembly for selectively releasing the bowstring when a user pulls the trigger.

Most crossbow products in the market only allow the user to shoot one type of projectile, either arrows or steel balls. They cannot be switched to different shooting modes. And while some crossbows may be switched between shooting modes, typically the conversion is cumbersome.

Thus, there exists a continuing need for a multifunctional crossbow which can be easily converted between arrow shooting mode and ball shooting mode, and which can be aimed efficiently and accurately in both modes. The present invention substantially fulfills this need.

SUMMARY OF THE INVENTION

The present invention is directed to a crossbow operable for shooting missiles, said crossbow comprising: (I) a bow comprising (a) a left-side bowhead and a right-side bowhead; (b) a left-side bow limb and a right-side bow limb; (c) a cam wheel affixed to the anterior end and the posterior end of each of said left-side and right-side bowheads and said left-side and right-side bow limbs, wherein each of said cam wheels comprises a top groove and a bottom groove, wherein each of said grooves is adapted to receive a bowhead string; (d) firing means operable for propelling said missile, said firing means comprising (i) a left-side bowhead string and a right-side bowhead string, wherein said left-side bowhead string engages with each of said cam wheels affixed to said left-side bowhead and with each of said cam wheels affixed to said left-side bow limb via said cam wheel grooves, and wherein said right-side bowhead string engages with each of said cam wheels affixed to said right-side bowhead and with each of said cam wheels affixed to said right-side bow limb via said cam wheel grooves; (ii) a connecting string, wherein said connecting string connects said left-side bowhead string to said right-side bowhead string; (iii) a retention base affixed to said connecting string; and (iv) a trigger engagement means affixed to said connecting string; and (II) a tiller having triggering means engageable with said trigger engagement means of said firing means for cocking and firing said crossbow.

In another embodiment, the present invention provides a crossbow operable for shooting missiles, said crossbow comprising: (I) a bow comprising (a) a left-side bowhead and a right-side bowhead; (b) a left-side bow limb and a right-side bow limb; (c) a cam wheel affixed to the anterior end and the posterior end of each of said left-side and right-side bowheads and said left-side and right-side bow limbs, wherein each of said cam wheels comprises a top groove and a bottom groove, wherein each of said grooves is adapted to receive a bowhead string; (d) firing means operable for propelling said missile, said firing means comprising (i) a top left-side bowhead string and a bottom left-side bowhead string, wherein said top left-side bowhead string engages with each of said cam wheels affixed to said left-side bowhead and with each of said cam wheels affixed to said left-side bow limb via said cam wheel top grooves, and wherein said bottom left-side bowhead string engages with each of said cam wheels affixed to said left-side bowhead and with each of said cam wheels affixed to said left-side bow limb via said cam wheel bottom grooves; (ii) a top right-side bowhead string and a bottom right-side bowhead string, wherein said top right-side bowhead string engages with each of said cam wheels affixed to said right-side bowhead and with each of said cam wheels affixed to said right-side bow limb via said cam wheel top grooves, and wherein said bottom right-side bowhead string engages with each of said cam wheels affixed to said right-side bowhead and with each of said cam wheels affixed to said right-side bow limb via said cam wheel bottom grooves; (iii) a connecting string, wherein said connecting string connects said top and bottom left-side bowhead strings to said top and bottom right-side bowhead strings; (iv) a retention base affixed to said connecting string; and (v) a trigger engagement means affixed to said connecting strings; and (II) a tiller having triggering means engageable with said trigger engagement means of said firing means for cocking and firing said crossbow.

BRIEF DESCRIPTION OF THE DRAWINGS

The invention will be better understood and objects other than those set forth above will become apparent when consideration is given to the following detailed description thereof. Such description makes reference to the annexed drawings wherein.

In the following description of the invention similar reference characters refer to similar parts throughout the several views of the drawings.

DETAILED DESCRIPTION

Figure 1:
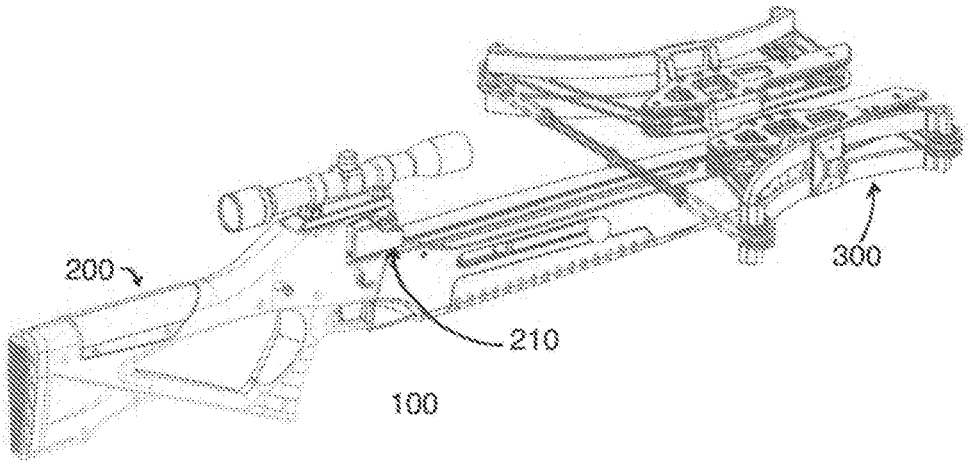
FIG. 1 is a side view of a crossbow of the present invention having a tiller and bow of the invention.

FIG. 1 shows crossbow 100 of the present invention, with bow 300 mounted on tiller 200. Tiller 200 has triggering means 210, which is engageable with trigger engagement means 390 (see FIG. 2) for cocking and firing the crossbow.

Figure 2:
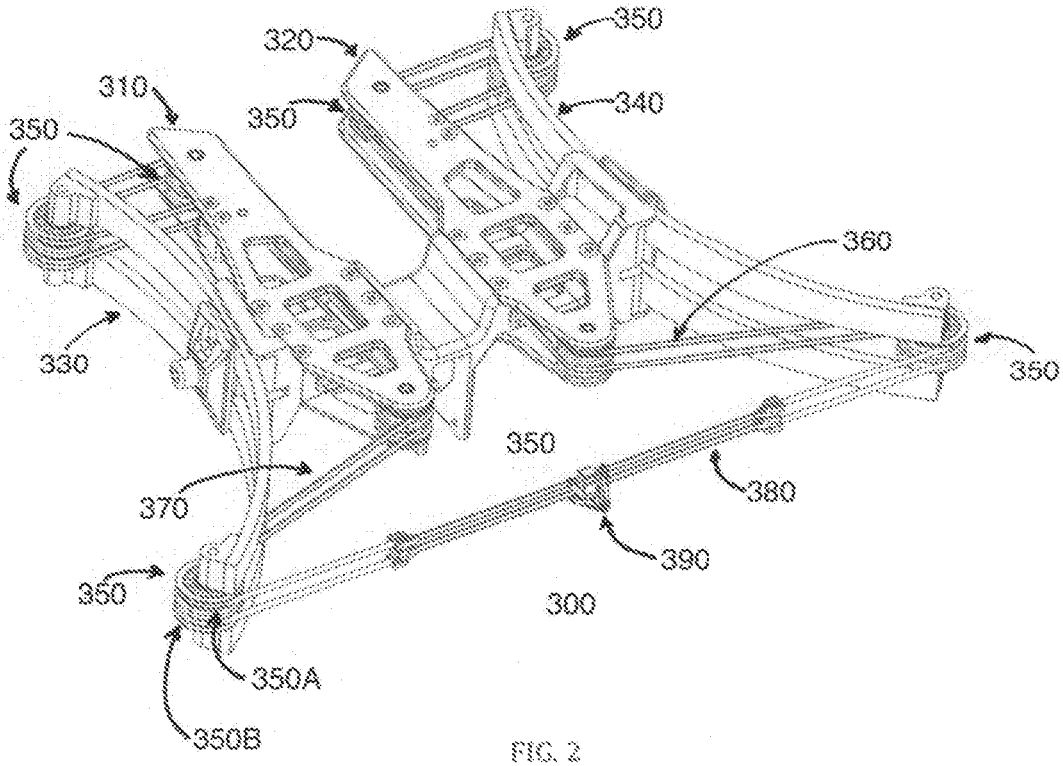
FIG. 2 is a top view of a bow of the invention.

FIG. 2 shows bow 300 having left-side bowhead 310 and right-side bowhead 320. Platform 315 connects left-side bowhead 310 and right-side bowhead 320. Left-side bowhead 310 is affixed to left-side bow limb 330, and right-side bowhead 320 is affixed to right-side bow limb 340. Cam wheels 350 are affixed to the anterior end and the posterior end of each of left-side bowhead 310, right-side bowhead 320, left-side bow limb 330 and right-side bow limb 340. Each of the eight cam wheels 350 has a top groove 350A and a bottom groove 350B which are adapted to receive a bowhead string. Bow 300 further includes left-side bowhead string 370, right-side bowhead string 360, connecting strings 380, trigger engagement means 390 and retention base 392. Left-side bowhead string 370 engages with each of the cam wheels 350 affixed to left-side bowhead 310 and with each of the cam wheels 350 affixed to left-side bow limb 330 via cam wheel grooves 350A and 350B. Likewise, right-side bowhead string 360 engages with each of the cam wheels 350 affixed to right-side bowhead 320 and with each of the cam wheels 350 affixed to right-side bow limb 340 via cam wheel grooves 350A and 350B. Connecting strings 380 connects said left-side bowhead string 370 to said right-side bowhead string 360. Trigger engagement means 390 and retention base 392 are affixed to connecting strings 380. In operation, triggering means 210 of tiller 200 (see FIG. 1) engages with trigger engagement means 390 for cocking and firing the crossbow. As shown in FIG. 2, engagement means 390 may be, for example, a drawstring.

Figure 3:
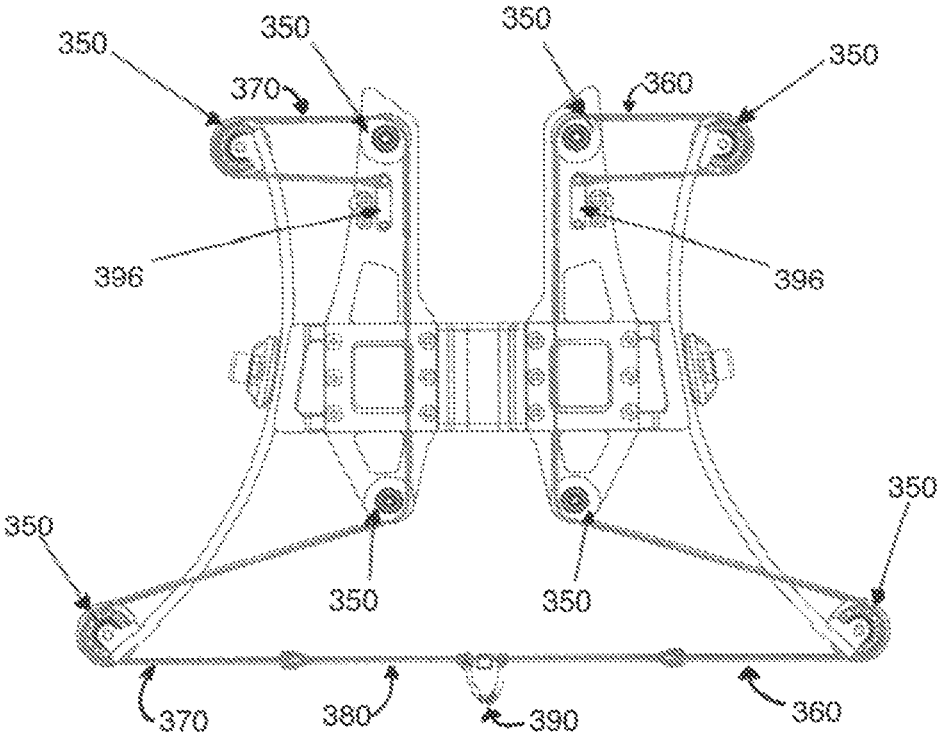
FIG. 3 is a top perspective view of a bow of the invention, showing the arrangement of the bowstrings relative to the bow.

FIG. 3 shows bow 300 having left-side bowhead 310, right-side bowhead 320, platform 315, left-side bow limb 330, right-side bow limb 340, cam wheels 350, left-side bowhead string 370, right-side bowhead string 360, connecting strings 380, trigger engagement means 390, retention base 392 and trajectory adjustment means 396. As shown, left-side bowhead string 370 engages with trajectory adjustment means 396 affixed to left-side bowhead 310, cam wheels 350 affixed to left-side bowhead 310 and left-side bow limb 330, and connecting string 380. Similarly, right-side bowhead string 360 engages with trajectory adjustment means 396 affixed to right-side bowhead 320, cam wheels 350 affixed to right-side bowhead 320 and right-side bow limb 340, and connecting strings 380. In operation, trajectory adjustment means 396 is used to adjust the trajectory of the missile to be fired from the crossbow.

Figure 4A:
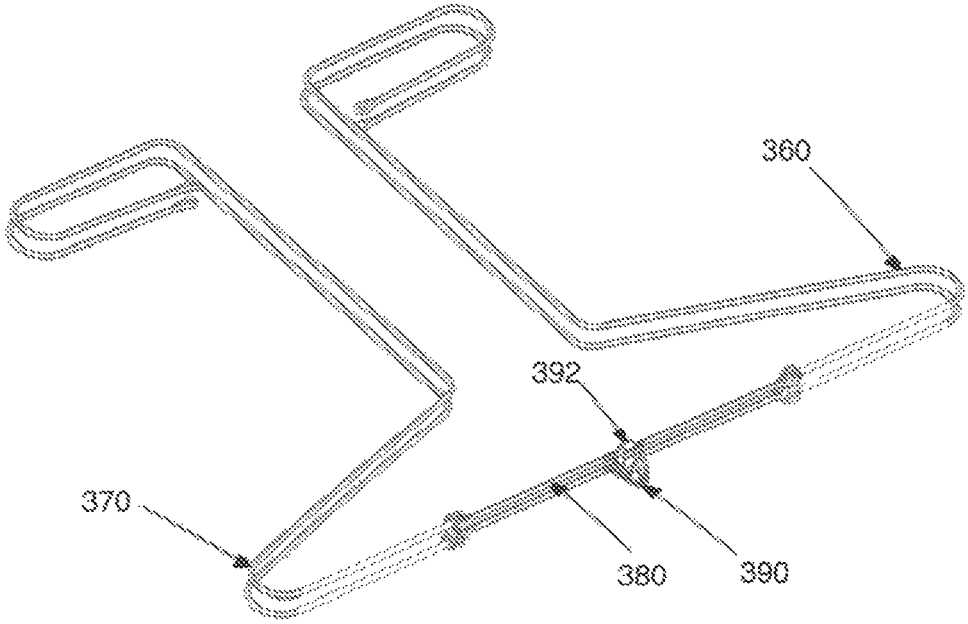
FIG. 4A is a top perspective view of the bowstrings of the invention.

FIG. 4A shows the bowstrings of the invention. As shown, left-side bowstring 370 folds in half where it connects to connecting strings 380, which in turn are connected to right-side bowstring 360, which also folds in half where it connects to connecting strings 380. Trigger engagement means 390 and retention base 392 are affixed to connecting strings 380.

Figure 4B:
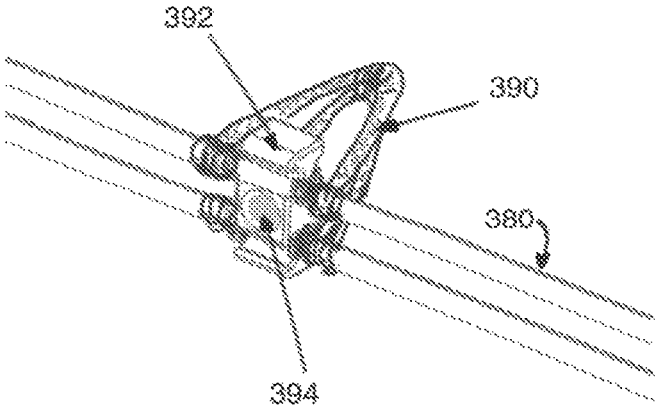
FIG. 4B is a top perspective view of the trigger engagement means of the invention.

FIG. 4B shows trigger engagement means 390 and retention base 392 affixed to connecting strings 380. As shown, retention base 392 includes a magnet 394 for securing the missile to the retention base 392.

Figure 5A:
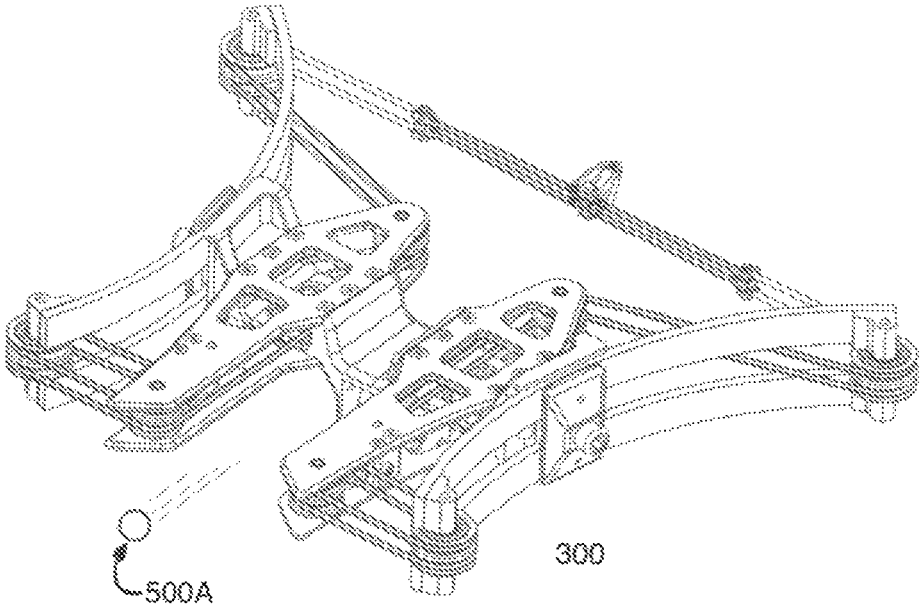
FIG. 5A is a top view of the bow of the invention having fired a ball.

FIG. 5A shows crossbow 300 firing ball 500A.

Figure 5B:
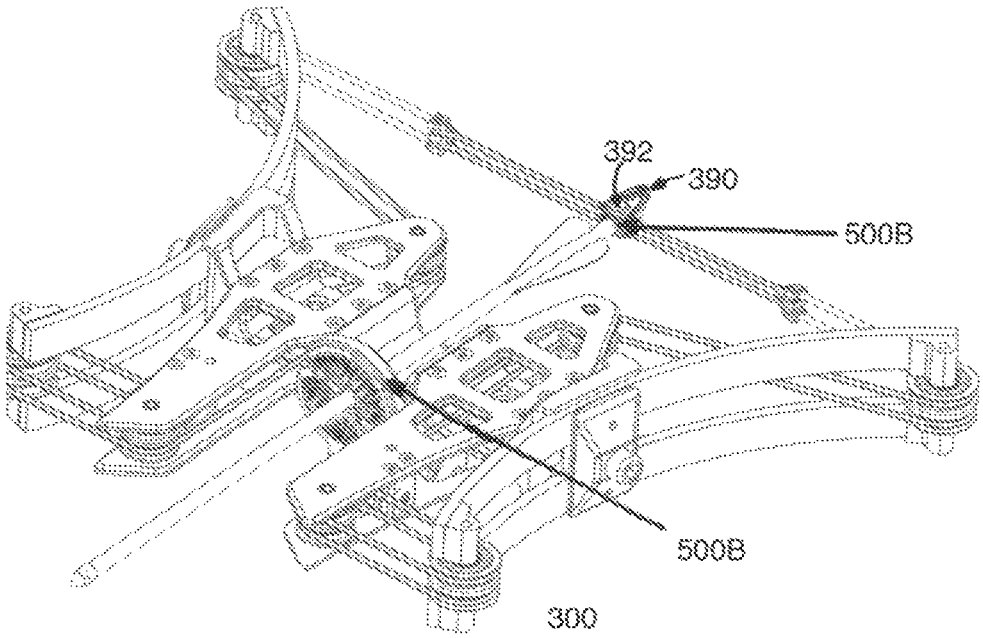
FIG. 5B is a top view of a bow of the invention with an arrow loaded for firing.

FIG. 5B shows arrow 500B in position to be fired by crossbow 300.

While particular embodiments of the present invention have been shown and described herein for purposes of illustration, it will be understood that the invention is not limited thereto. Modifications may be made by persons skilled in the art, particularly in light of the foregoing teachings, without deviating from the spirit and scope of the invention. Accordingly, the invention is not limited except as by the appended claims.

All of the U.S. patents referred to in this specification are incorporated herein by reference in their entirety to the extent not inconsistent with the present description.

What is claimed is:

1. A crossbow operable for shooting missiles, said crossbow comprising:

(I) a bow comprising:

(a) a left-side bowhead and a right-side bowhead;

(b) a left-side bow limb and a right-side bow limb;

(c) 8 cam wheels, which are respectively affixed to an anterior end and an posterior end of each of said left-side and right-side bowheads and said left-side and right-side bow limbs, wherein each of said cam wheels comprises a top groove and a bottom groove, wherein each of said grooves is adapted to receive a bowhead string;

(d) firing means operable for propelling said missile, said firing means comprising (i) top and bottom connecting strings, wherein said top connecting string connects a top left-side bowhead string to a top right-side bowhead string and said bottom connecting string connects a bottom left-side bowhead string to a bottom right-side bowhead string;

(ii) a retention base affixed to said top and bottom connecting strings;

(iii) a trigger engagement means affixed to said top and bottom connecting strings;

(iv) said top right-side bowhead string and bottom right-side bowhead string, wherein the top right-side bowhead string is engaged with a right trajectory adjustment means affixed to the right-side bowhead, the top wheel groove of the anterior cam wheel affixed to the right-side bow limb, the top wheel groove of the anterior cam wheel affixed to the right-side bowhead, the top wheel groove of the posterior cam wheel affixed to the right-side bowhead, the top wheel groove of the posterior cam wheel affixed to the right-side bow limb, and connected to the top connecting string, and wherein the bottom right-side bowhead string engages a right trajectory adjustment means affixed to the right-side bowhead, the bottom wheel groove of the anterior cam wheel affixed to the right-side bow limb, the bottom wheel groove of the anterior cam wheel affixed to the right-side bowhead, the bottom wheel groove of the posterior cam wheel affixed to the right-side bowhead, the bottom wheel groove of the posterior cam wheel affixed to the right-side bow limb, and connected to the bottom connecting string; and (v) said top left-side bowhead string and bottom left-side bowhead string, wherein the top left-side bowhead string is engaged with a left trajectory adjustment means affixed to the left-side bowhead, the top wheel groove of the anterior cam wheel affixed to the left-side bow limb, the top wheel groove of the anterior cam wheel affixed to the left-side bowhead, the top wheel groove of the posterior cam wheel affixed to the left-side bowhead, the top wheel groove of the posterior cam wheel affixed to the left-side bow limb, and connected to the top connecting string, and wherein the bottom left-side bowhead string engages a left trajectory adjustment means affixed to the left-side bowhead, the bottom wheel groove of the anterior cam wheel affixed to the left-side bow limb, the bottom wheel groove of the anterior cam wheel affixed to the left-side bowhead, the bottom wheel groove of the posterior cam wheel affixed to the left-side bowhead, the bottom wheel groove of the posterior cam wheel affixed to the left-side bow limb, and connected to the bottom connecting string; and (II) a tiller, comprising a tiller triggering means engageable with said trigger engagement means of said firing means for cocking and firing said crossbow.

2. The crossbow according to claim 1, wherein said firing means further comprises a releasing string engaged with said connecting string.

3. The crossbow according to claim 1, further comprising a removable arrow platform located between said left-side bowhead and said right-side bowhead.

4. The crossbow according to claim 1, further comprising a retention base affixed to said connecting string, said retention base adapted to receive a missile.

5. The crossbow according to claim 4, wherein said missile is an arrow or a marble-sized ball.

6. The crossbow according to claim 4, wherein said retention bases comprises a magnetic surface.

7. The crossbow according to claim 1, further comprising a second connecting string, wherein said second connecting string connects at least one of said left-side bowhead strings to at least one of said right-side bowhead strings.

8. The crossbow according to claim 7, wherein said firing means further comprises a releasing string engaged with each of said connecting strings.

9. The crossbow according to claim 8, wherein said firing means further comprises a second releasing string engaged with each of said connecting strings.

* * * * *